US005411260A

United States Patent [19]

Smith

[11] Patent Number: 5,411,260

[45] Date of Patent: May 2, 1995

[54] GAME

[75] Inventor: Judy F. Smith, Gainesville, Ga.

[73] Assignee: Dittler Brothers Incorporated, Atlanta, Ga.

[21] Appl. No.: 251,593

[22] Filed: May 31, 1994

[51] Int. Cl.[6] ..... A63F 3/06

[52] U.S. Cl. ..... 273/139; 273/269; 283/903

[58] Field of Search ..... 273/138 R, 139, 269, 273/275; 283/901, 903, 98, 100, 101, 102, 103, 105

[56] References Cited

U.S. PATENT DOCUMENTS 5,046,737 9/1991 Fierberg ..... 273/903
5,074,566 12/1991 Desbiens ..... 283/903
5,092,598 3/1992 Kamille ..... 273/139
5,118,109 6/1992 Gumina ..... 273/139
5,193,815 3/1993 Pollard ..... 273/139

*Primary Examiner*—Vincent Millin
*Assistant Examiner*—William M. Pierce
*Attorney, Agent, or Firm*—Kilpatrick & Cody

[57] ABSTRACT

A game resembling a maze is disclosed. The game is formed of a substrate onto which distinct grids are printed, each containing multiple numerals or other suitable symbols. Opaque coatings cover both grids, concealing the symbols printed on the substrate, and adjacent boxes of one grid create multiple pathways from one border of the grid to another. In use, a player removes selected portions of the opaque coatings to determine whether adjacent boxes containing certain exposed symbols form a continuous path connecting separate borders of the grid.

12 Claims, 4 Drawing Sheets

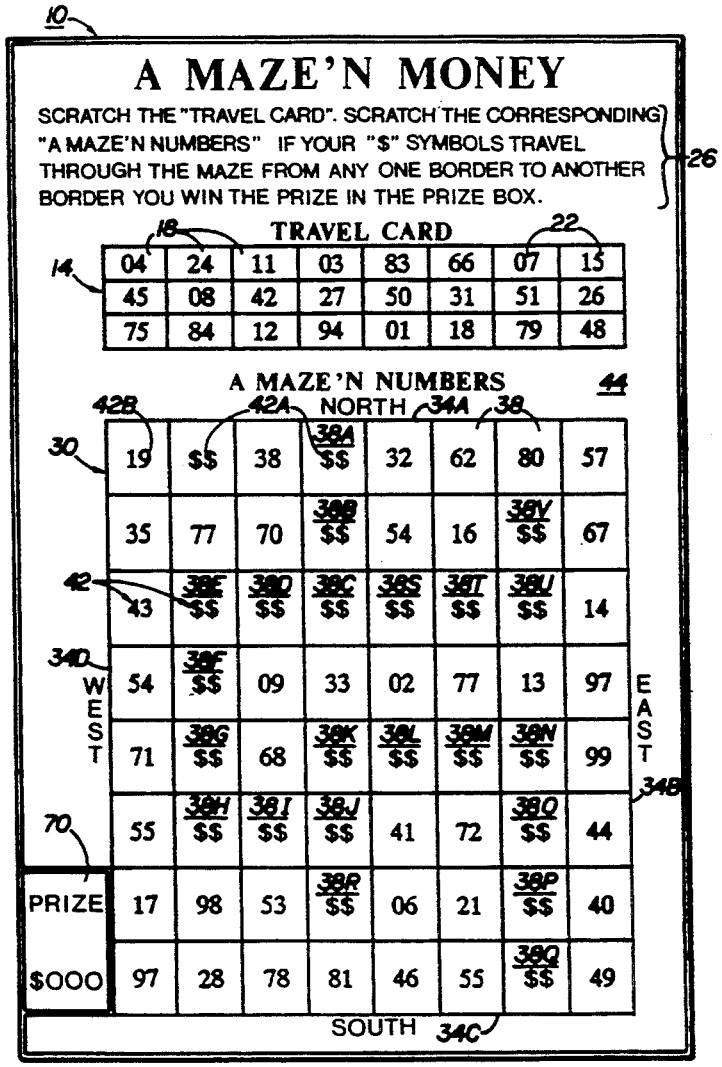

10

A MAZE'N MONEY

SCRATCH THE "TRAVEL CARD". SCRATCH THE CORRESPONDING "A MAZE'N NUMBERS". IF YOUR "$" SYMBOLS TRAVEL THROUGH THE MAZE FROM ANY ONE BORDER TO ANOTHER BORDER YOU WIN THE PRIZE IN THE PRIZE BOX. 26

TRAVEL CARD 18 22 14

| | | | | | | | |
|---|---|---|---|---|---|---|---|
| 04 | 24 | 11 | 03 | 83 | 66 | 07 | 15 |
| 45 | 08 | 42 | 27 | 50 | 31 | 51 | 26 |
| 75 | 84 | 12 | 94 | 01 | 18 | 79 | 48 |

A MAZE'N NUMBERS 44

42B 42A NORTH 34A 38 30 42 34D WEST EAST 34B 70 34C

| | | | | | | | |
|---|---|---|---|---|---|---|---|
| 19 | $$ | 38 | 38A $$ | 32 | 62 | 80 | 57 |
| 35 | 77 | 70 | 38B $$ | 54 | 16 | 38V $$ | 67 |
| 43 | 38E $$ | 38D $$ | 38C $$ | 38S $$ | 38T $$ | 38U $$ | 14 |
| 54 | 38F $$ | 09 | 33 | 02 | 77 | 13 | 97 |
| 71 | 38G $$ | 68 | 38K $$ | 38L $$ | 38M $$ | 38N $$ | 99 |
| 55 | 38H $$ | 38I $$ | 38J $$ | 41 | 72 | 38O $$ | 44 |
| PRIZE | 17 | 98 | 53 | 38R $$ | 06 | 21 | 38P $$ | 40 |
| $000 | 97 | 28 | 78 | 81 | 46 | 55 | 38Q $$ | 49 |

SOUTH

FIG 1

50

A MAZE'N MONEY

SCRATCH THE "TRAVEL CARD". SCRATCH THE CORRESPONDING "A MAZE'N NUMBERS". IF YOUR "$" SYMBOLS TRAVEL THROUGH THE MAZE FROM ANY ONE BORDER TO ANOTHER BORDER YOU WIN THE PRIZE IN THE PRIZE BOX.

54 TRAVEL CARD 46

66

| | | | | | | | |
|---|---|---|---|---|---|---|---|
| ?? | ?? | ?? | ?? | ?? | ?? | ?? | ?? |
| ?? | ?? | ?? | ?? | ?? | ?? | ?? | ?? |
| ?? | ?? | ?? | ?? | ?? | ?? | ?? | ?? |

A MAZE'N NUMBERS 58 42C 62 42C NORTH 46

| | | | | | | | | |
|---|---|---|---|---|---|---|---|---|
| | 19 | 94 | 38 | 15 | 32 | 62 | 80 | 57 |
| | 35 | 77 | 70 | 11 | 54 | 16 | 04 | 67 |
| | 43 | 27 | 24 | 12 | 08 | 75 | 45 | 14 |
| 54 WEST | 54 | 79 | 09 | 33 | 02 | 77 | 13 | 97 EAST |
| | 71 | 48 | 68 | 18 | 66 | 01 | 12 | 99 |
| | 55 | 18 | 48 | 07 | 41 | 72 | 83 | 44 |
| PRIZE | 17 | 98 | 53 | 51 | 06 | 21 | 79 | 40 |
| $OOO | 97 | 28 | 78 | 81 | 46 | 55 | 03 | 49 |

SOUTH

FIG 2

50

A MAZE'N MONEY

SCRATCH THE "TRAVEL CARD". SCRATCH THE CORRESPONDING "A MAZE'N NUMBERS". IF YOUR "$" SYMBOLS TRAVEL THROUGH THE MAZE FROM ANY ONE BORDER TO ANOTHER BORDER YOU WIN THE PRIZE IN THE PRIZE BOX.

TRAVEL CARD

| | | | | | | | |
|---|---|---|---|---|---|---|---|
| 04 | 24 | 11 | 03 | 83 | 66 | 07 | 15 |
| 45 | 08 | 42 | 27 | 50 | 31 | 51 | 26 |
| 75 | 84 | 12 | 94 | 01 | 18 | 79 | 48 |

A MAZE'N NUMBERS

NORTH

38

68

70

| | | | | | | | | |
|---|---|---|---|---|---|---|---|---|
| | 19 | $$ | 38 | $$ | 32 | 62 | 80 | 57 |
| | 35 | 77 | 70 | $$ | 54 | 16 | $$ | 67 |
| | 43 | $$ | $$ | $$ | $$ | $$ | $$ | 14 |
| WEST | 54 | $$ | 09 | 33 | 02 | 77 | 13 | 97 EAST |
| | 71 | $$ | 68 | $$ | $$ | $$ | $$ | 99 |
| | 55 | $$ | $$ | $$ | 41 | 72 | $$ | 44 |
| PRIZE | 17 | 98 | 53 | $$ | 06 | 21 | $$ | 40 |
| $OOO | 97 | 28 | 78 | 81 | 46 | 55 | $$ | 49 |

SOUTH

FIG 3

22 14

| | | | | | | | |
|---|---|---|---|---|---|---|---|
| 01 | 24 | 11 | 03 | 83 | 66 | 07 | 15 |
| 01 | 24 | 11 | 03 | 83 | 66 | 07 | 15 |
| 45 | 08 | 42 | 27 | 50 | 31 | 51 | 26 |
| 45 | 08 | 42 | 27 | 50 | 31 | 51 | 26 |
| 75 | 84 | 12 | 94 | 01 | 18 | 79 | 48 |
| 75 | 84 | 12 | 94 | 01 | 18 | 79 | 48 |

30 42A 42B 38

| | | | | | | | |
|---|---|---|---|---|---|---|---|
| WRONG WAY | $$ MONEY | WRONG WAY | $$ MONEY | WRONG WAY | WRONG WAY | WRONG WAY | WRONG WAY |
| WRONG WAY | WRONG WAY | WRONG WAY | $$ MONEY | WRONG WAY | WRONG WAY | $$ MONEY | WRONG WAY |
| WRONG WAY | $$ MONEY | $$ MONEY | $$ MONEY | $$ MONEY | $$ MONEY | $$ MONEY | WRONG WAY |
| WRONG WAY | $$ MONEY | WRONG WAY | WRONG WAY | WRONG WAY | WRONG WAY | WRONG WAY | WRONG WAY |
| WRONG WAY | $$ MONEY | WRONG WAY | $$ MONEY | $$ MONEY | $$ MONEY | $$ MONEY | WRONG WAY |
| WRONG WAY | $$ MONEY | $$ MONEY | $$ MONEY | WRONG WAY | WRONG WAY | $$ MONEY | WRONG WAY |
| WRONG WAY | WRONG WAY | WRONG WAY | $$ MONEY | WRONG WAY | WRONG WAY | $$ MONEY | WRONG WAY |
| WRONG WAY | WRONG WAY | WRONG WAY | WRONG WAY | WRONG WAY | WRONG WAY | $$ MONEY | WRONG WAY |

FIG 4

GAME

This invention relates to a game and more particularly to one in which an opaque covering is removed from the game piece to reveal hidden symbols.

BACKGROUND OF THE INVENTION

Lotteries and commercial promotions have popularized games in which players can learn immediately whether they have won a sought-after prize. These "instant-win" games often consist of card stock onto which prize-related symbols are printed. The symbols are subsequently covered by an opaque layer of material, typically latex, to hide the symbols from view. After obtaining possession of such an instant-win game, the player need merely remove the opaque covering to expose the prize-related symbols.

Desbiens U.S. Pat. No. 5,074,566 discloses one such "instant-win" game. As described in the Desbiens patent, a multi-box grid containing randomly-selected numbers and, in at least one box, an "instant prize" symbol is printed onto a substrate. The printed grid is thereafter covered with a "scratchable," opaque coating and the coating overprinted with a second grid containing numerals identical to those covered by the opaque coating. The overprinted grid does not include the instant prize symbol or symbols hidden by the coating, however, so their presence initially remains unknown to the recipient of the game. By removing the opaque coating, the player can view the instant prize symbols printed on the substrate and, presumably, immediately determine whether a sought-after prize has been won.

SUMMARY OF THE INVENTION

The present invention provides an alternative to this and other existing "scratch-off" games. Embodiments of the invention include a substrate onto which two distinct grids are printed, each containing multiple numbers or other suitable symbols formed either randomly or in a predetermined sequence (or partly of both). Opaque coatings cover both grids, concealing the symbols printed on the substrate. Onto one coating symbols are printed within a grid partially identical to those contained within the covered grid, informing the player of at least some of the symbols underneath the opaque coating. The symbols contained within the other grid initially remain wholly unknown, however. In other embodiments of the invention, the symbols appearing within both covered grids initially remain unknown, although some correspond to those printed on the opaque coating.

In use, the overprinted grid forms a maze in which adjacent boxes create multiple pathways from one border of the rectangular grid to another. To play, the recipient of the substrate initially removes the non-overprinted opaque coating, exposing a first set of symbols contained with the "travel" grid. For each such exposed symbol, the player then determines whether the identical symbol appears within a box printed onto the other opaque covering. If it does, the player removes the opaque covering from that box, thereby exposing the symbol printed on the substrate in the "maze" grid. In some cases, the exposed symbol will be identical to that printed onto the now-removed coating. In others, the exposed symbol will differ, informing the player that the correct box has been uncovered and that the now-exposed "maze box" is part of the instant-win maze. Alternatively, all exposed symbols may differ from those printed onto the opaque coating. In such embodiments some of the exposed symbols correlate with those printed on the opaque coating, however, again indicating to the player that the correct box has been revealed.

Because the color of this opaque covering differs from that of the substrate background, the visible contrast between the two will confirm removal of the covering from each particular box. After the player has matched each symbol in the "travel" grid with those appearing over the "maze" grid and removed the appropriate covering, he or she determines from the contrasting colors whether any exposed "maze boxes" provide a continuous pathway from one border of the "maze" grid to another. If they do, the player wins a prize either specified elsewhere on the game or determined through other means.

It is thus an object of the present invention to provide a game formed of a substrate, printed symbols, and means for initially concealing the printed symbols from view.

It is an additional object of the present invention to provide a game in which the symbols are positioned to resemble a maze.

It is also an object of the present invention to provide a game containing at least two grids printed on the substrate and concealed by opaque coverings, at least one of which is overprinted with symbols.

It is another object of the present invention to provide a game in which the overprinted symbols either match or correspond with at least some of those concealed by the opaque covering.

It is yet another object of the present invention to provide a game in which the color of the substrate background differs from that of at least one of the opaque coverings.

Other objects, features, and advantages of the present invention will become apparent with reference to the remainder of the written portion and the drawings of this application.

BRIEF DESCRIPTION OF THE DRAWINGS

FIG. 1 is a plan view of a sample substrate which may be used in connection with the present invention and onto which symbols have been printed.

FIG. 2 is a plan view of the substrate of FIG. 1 following application of opaque coatings and overprinting to create a sample game card of the present invention.

FIG. 3 is a plan view of the game card of FIG. 2 following play.

FIG. 4 is a plan view of alternative sets of symbols that may be printed onto the substrate of FIG. 1.

DETAILED DESCRIPTION

FIG. 1 illustrates an exemplary substrate 10 for use in connection with the present invention. Substrate 10 may, but need not, be conventional card stock. Printed on substrate 10 is first grid 14, defining multiple boxes 18 in which symbol sets 22 are printed. In the embodiment of FIG. 1, first grid 14 is rectangular and defines a matrix of boxes 18. One symbol set 22 is printed in each box 18, and each symbol set 22 is unique within first grid 14. Symbol sets 22 may be numeric as shown in FIG. 1, although alpha-numerics and other characters may be used either alternatively or additionally.

Substrate 10 may also include printed instructions 26 and other information if desired. As shown in FIG. 1, first grid 14 may be denominated the "travel" card, as symbol sets 22 printed therein ultimately dictate how the player "travels" when playing the game. Nominally square second grid 30, also printed on substrate 10, defines the boundaries 34A–D within which the game is played. Like first grid 14, second grid 30 defines multiple boxes 38 into which symbol sets 42 are printed, again typically one set 42 per box 38. Unlike first grid 14, however, not all symbols sets 42 are unique within second grid 30. Instead, symbol sets 42 include first symbols 42A and second symbols 42B, with multiple identical first symbols 42A appearing within boxes 38. Each second symbol 42B, of the same type as symbol sets 22 (i.e. numeric, alpha-numeric, etc.), may, but need not, be unique within second grid 30. Alternatively, as in FIG. 4, each second symbol 42B may comprise an alphabetic phrase such as "WRONG WAY" or otherwise indicate that an incorrect box 38 has been uncovered.

The embodiment of FIG. 1 illustrates identical first symbols 42A printed within each of boxes 38A–V. Boxes 38A–V define numerous partial pathways within second grid 30, some of which do not span grid 30 between two of boundaries 34A, 34B, 34C, and 34D. Boxes 38A–Q form a continuous pathway from boundary 34A to boundary 34C of second grid 30, however, providing the means for a player to prevail when playing the game. As shown in FIG. 1, each box 38B–P has a common border with at least two other boxes 38B–P, and boxes 38A and 38Q share borders with, respectively, box 38B and boundary 34A and box 38Q and boundary 34C.

Applied atop substrate 10 and the information printed thereon is at least one non-opaque, typically transparent coating 44. Coating(s) 44 may be used to seal substrate 10 and protect it from, e.g., being damaged by spilled liquids or chemical or other tampering. One or more coatings 44 may also constitute a "release" coating designed to facilitate removal of opaque covering 46 by the player. FIG. 2 details an exemplary game piece 50 thus created, including overprinting 54 above at least second grid 30.

When provided to a player for use, game piece 50 functionally resembles the sample shown in FIG. 2. Opaque coating 46, which may be a synthetic rubber (such as latex) or any other removable coating, covers first and second grids 14 and 30 of game piece 50, thereby concealing symbol sets 22 and 42 from view. Opaque coating 46 additionally is colored differently than substrate 10 (or at least the portions of substrate 10 underlying second grid 30) so that the contrasting colors indicate when portions of opaque coating 46 have been removed.

Overprinting 54 atop opaque coating 46 creates third grid 58, the same size and placement on substrate 10 as second grid 30. Third grid 58 also defines boxes 62 equal in number to and overlaying the boxes 38 in second grid 30. For each box 38 in which a second symbol 42B appears, overprinting 54 either duplicates that symbol in the corresponding overlaying box 62 (as in FIG. 2) or creates a symbol different from each second symbol 42B. Printed within the remainder of boxes 62 are additional symbols 42C, however, of the same type as the symbols of symbol set 22. Thus, third grid 58 does not reveal to the player the presence and location of any first symbols 42A in second grid 30, although symbols 42C correspond to and are printed atop symbols 42A. For embodiments of the invention consistent with FIG. 4, moreover, third grid 58 reveals neither first symbols 42A nor second symbols 42B, even though some correlation between symbols 42C and first symbols 42A exists.

If desired, overprinting 54 may be used to create a fourth grid 66 atop first grid 14. Although such a fourth grid 66 is illustrated in FIG. 2 atop first grid 14, it need not be present, as the player is instructed to remove the entirety of opaque coating 46 covering first grid 14. In fact, first grid 14 need not even be covered with opaque coating 46, although doing so clearly enhances the mystique of the overall game.

Assuming opaque coating 46 covers first grid 14, to play the game the recipient of game piece 50 initially removes, or "scratches-off," the opaque coating 46. Doing so exposes first grid 14 and its corresponding symbol sets 22 within boxes 18. For each symbol set 22, the player then determines whether the set 22 matches any of symbols 42B or 42C included in boxes 62 of third grid 58. If it does, the player removes opaque coating 46 from the box(es) 62 containing the matched symbols, exposing, with contrasting background, corresponding box(es) 38 of second grid 30 (see FIG. 3).

After exhausting symbol set 22, the player examines the exposed boxes 38 of second grid 30 to ascertain whether any first symbols 42A have been revealed and, if so, whether a sufficient number have been exposed to form a continuous path between any two of boundaries 34A–D of second grid 30. As shown in FIG. 3, for sample game piece 50 the player's actions have revealed such a path 68 through the maze of boxes 38 from boundary 34A to boundary 34C. Sample game piece 50 is, therefore, a "winning" one, entitling the player to a prize either as specified in compartment 70 or otherwise determined.

The present invention is designed to provide, in an "instant-win" or "scratch-off" format, a game analogous in at least some respects to navigating through a maze. Thus, although the foregoing is provided for purposes of illustrating, explaining, and describing embodiments of the present invention, modifications and adaptations to these embodiments will be apparent to those skilled in the art and may be made without departing from the scope or spirit of the invention.

I claim:

1. A game piece comprising:

a. a substrate;

b. a grid of indicia printed onto the substrate at a first location and defined by an $N \times M$ matrix of first boxes, where N and M are variable numbers, at least a variable number, P, of the first boxes having a symbol of a first symbol type printed therein and the remainder of the first boxes having a symbol of a second symbol type printed therein, where P equals the lesser of N and M;

c. a variable number of at least the P number of symbols of a third symbol type printed on the substrate at a second location;

d. a removable coating applied onto the boxes of the grid of indicia to conceal the symbols printed therein; and e. indicia printed onto the removable coating, each indicia being a symbol of the third symbol type, and at least some of which symbols are identical to the symbols of the third symbol type printed on the substrate at the second location.

2. A game piece according to claim 1 further comprising a second removable coating applied onto the symbols printed on the substrate at the second location.

3. A game piece according to claim 1 in which the symbols of the third symbol type are numerals.

4. A game piece according to claim 3 in which the symbols of the second symbol type are alphabetic.

5. A game piece according to claim 3 in which the symbols of the second symbol type are numerals.

6. A method of manufacturing a game piece, comprising the steps of:

a. providing a substrate;

b. printing onto a first location of the substrate a grid of indicia defining an N×M matrix of first boxes, where N and M are variable numbers, at least a variable number, P, of the first boxes having a symbol of a first symbol type printed therein and the remainder of the first boxes having a symbol of a second symbol type printed therein, where P equals the lesser of N and M;

c. printing onto a second location of the substrate a variable number of at least the P number of symbols of a third symbol type;

d. applying a removable coating onto the boxes of the grid of indicia to conceal the symbols printed therein; and e. printing onto the removable coating indicia, each indicia being a symbol of the third symbol type, at least some of which symbols of the third symbol type are identical to the symbols printed on the substrate at the second location.

7. A method according to claim 6 further comprising the step of applying a removable coating onto the symbols printed on the substrate at the second location.

8. A method of manufacturing and playing a game, comprising the steps of:

a. providing a substrate;

b. printing onto a first location of the substrate a grid of indicia defining at least two boundaries and an N×M matrix of first boxes, where N and M are variable numbers, at least a variable number, P, of the first boxes having a symbol of a first symbol type printed therein and the remainder of the first boxes having a symbol of a second symbol type printed therein, where P equals the lesser of N and M;

c. printing onto a second location of the substrate a variable number of at least the P number of symbols of a third symbol type;

d. applying a first removable coating onto the boxes of the grid of indicia to conceal the symbols printed therein;

e. printing onto the first removable coating indicia, each indicia being a symbol of the third symbol type, at least some of which symbols are identical to P of the symbols of the third symbol type printed on the substrate at the second location;

f. applying a second removable coating onto the symbols printed on the substrate at the second location;

g. removing the second removable coating expose the symbols printed on the substrate at the second location;

h. matching a plurality of the symbols printed on the substrate at the second location with a plurality of the symbols of the indicia;

i. removing the first removable coating underlying the indicia matched in step "h" to expose a plurality of the first boxes; and j. examining the symbols printed in the plurality of exposed first boxes to determine whether any are of the first symbol type and, if so, whether the exposed first boxes in which the symbols of the first symbol type are printed extend between the two boundaries of the grid of indicia.

9. A method a manufacturing a game piece, comprising the steps of:

a. providing a substrate;

b. printing onto a first location of the substrate a border defining first and second boundaries and a plurality of boxes within the boundaries, each box adjacent to at least one other box;

c. printing within each of the boxes first or second sets of symbols, the boxes being printed with the first set of symbols forming a continuous path of adjacent boxes spanning the substrate between the first and second boundaries;

d. printing onto a second location of the substrate a third set of symbols;

e. applying a removable coating onto the boxes to conceal the first and second sets of symbols printed therein; and f. printing onto the removable coating a fourth set of symbols, some of which are identical to symbols of the third set of symbols and some but less than all of which correspond to and are printed atop symbols of the first set of symbols.

10. A method according to claim 1 in which the steps of printing second and third sets of symbols comprise printing numerals for the third set of symbols and alphabetic characters for the second set of symbols.

11. A method according to claim 1 in which the steps of printing second and third sets of symbols comprise printing numerals for both sets.

12. A game piece according to claim 5 in which N equals M.

* * * * *